US011528548B2

(12) United States Patent
Tseng et al.

(10) Patent No.: US 11,528,548 B2
(45) Date of Patent: Dec. 13, 2022

(54) HEADPHONE

(71) Applicant: Cheng Uei Precision Industry Co., LTD., New Taipei (TW)

(72) Inventors: Chi-Ming Tseng, New Taipei (TW); Chin-Chung Lin, New Taipei (TW)

(73) Assignee: CHENG UEI PRECISION INDUSTRY CO., LTD., New Tapei (TW)

( * ) Notice: Subject to any disclaimer, the term of this patent is extended or adjusted under 35 U.S.C. 154(b) by 6 days.

(21) Appl. No.: 17/400,090

(22) Filed: Aug. 11, 2021

(65) Prior Publication Data

US 2022/0191609 A1 Jun. 16, 2022

(30) Foreign Application Priority Data

Dec. 16, 2020 (CN) ..... 202023022395.5

(51) Int. Cl.
*H04R 1/10* (2006.01)
*H04R 1/08* (2006.01)

(52) U.S. Cl.
CPC ..... *H04R 1/1033* (2013.01); *H04R 1/08* (2013.01); *H04R 1/105* (2013.01); *H04R 1/1008* (2013.01); *H04R 1/1075* (2013.01); *H04R 2201/107* (2013.01)

(58) Field of Classification Search
CPC . H04R 1/00; H04R 1/02; H04R 1/028; H04R 1/04; H04R 1/08; H04R 1/083; H04R 1/10; H04R 1/1008; H04R 1/1033; H04R 1/105; H04R 1/1058; H04R 1/1075; H04R 2201/107
See application file for complete search history.

(56) References Cited

U.S. PATENT DOCUMENTS 8,861,766 B2 * 10/2014 Ouryouji ..... H04R 1/1058 381/370

FOREIGN PATENT DOCUMENTS

CN 1947457 A * 4/2007 ..... H04R 1/10
CN 201328175 Y * 10/2009 ..... H04R 1/10
CN 20367528 U * 6/2014 ..... H04R 1/10
(Continued)

OTHER PUBLICATIONS

CN-214756829, English Translation, Dated Nov. 2021.*
(Continued)

*Primary Examiner* — Thang V Tran
(74) *Attorney, Agent, or Firm* — Cheng-Ju Chicang

(57) ABSTRACT

A headphone includes a base, an accommodating space, a bracket, a circuit board accommodated in the accommodating space, a signal cable, a microphone assembly accommodated in the accommodating space, and a sound chamber unit accommodated in the accommodating space. The base has a sidewall and an outer wall surrounding the accommodating space. A junction portion between the sidewall and the outer wall is recessed inward to form a recess. At least one connection wall has a through hole communicated with the accommodating space. The bracket is received in the recess. The bracket includes an outer cover and an inner cover. A cable path is formed between the outer cover and the inner cover. One end of the bracket has a guiding slot connected to the cable path. The guiding slot is corresponding to the through hole. The signal cable is arranged along the cable path.

13 Claims, 14 Drawing Sheets

(56) References Cited

FOREIGN PATENT DOCUMENTS

| | | | | | |
|---|---|---|---|---|---|
| CN | 110273871 | A | * | 9/2019 | ..... H04R 1/10 |
| CN | 214756829 | U | * | 11/2021 | ..... H04R 1/10 |
| WO | WO-2006107274 | A1 | * | 10/2006 | ..... H04R 1/04 |

OTHER PUBLICATIONS

CN-110273871, English Translation, Dated Sep. 2019.*
CN-1947457, English Translation, Dated Apr. 2007.*
CN-201328175, English Translation, Dated Oct. 2006.*

* cited by examiner

HEADPHONE

CROSS-REFERENCE TO RELATED APPLICATION

The present application is based on, and claims priority from, China Patent Application No. 202023022395.5, filed Dec. 16, 2020, the disclosure of which is hereby incorporated by reference herein in its entirety.

BACKGROUND OF THE INVENTION

1. Field of the Invention

The present invention generally relates to a headphone, and more particularly to a headphone having a cable arrangement structure.

2. The Related Art

Generally, current earphones are various types. The current earphones include earbuds, in-ear earphones, headphones, etc. Compare the headphone with other earphones, and the headphone is able to cover a user's ear completely to make the headphone more comfortable to be worn. However, when users use the headphones, internal signal cables are discovered to be coiled in the headphones, and the internal signal cables will contact with devices in a sound chamber to produce abnormal noises, so inconveniences are caused to the users.

A conventional headphone is of a thin body supporting structure. The conventional headphone includes two main bodies, a headband, a connecting cable, two hollow spindles and two bracket units. Two ends of headband are connected with the two main bodies through the two bracket units. Each main body includes a housing, a cover connected with the housing, a control panel connected between the housing and the cover, and a loudspeaker disposed between the housing and the cover. Each bracket unit includes a bracket and a slide fastener. The bracket has a sliding slot, a first through hole and a second through hole. The headband includes a casing pipe, and a steel bar arranged in the casing pipe. Partial connecting cable projects into and is coiled in the housing. The two spindles are disposed between the housing and the bracket. A conventional arrangement way of the connecting cable is that the connecting cable is bent at a larger angle, and the connecting cable extends out of the bracket from the two spindles.

However, the above-mentioned connecting cable is coiled in the housing, and the connecting cable still occupies an internal space, so the connecting cable is still easy to contact with the devices in the sound chamber to produce the abnormal noises and only reduce a volume of the bracket, and the conventional headphone is still in a larger size.

Therefore, it is necessary to provide an innovative headphone different from the headphone with the above-mentioned structure, the innovative headphone has a cable arrangement structure, an inside space of the innovative headphone occupied by the signal cable is decreased to make the innovative headphone be able to be manufactured to be a smaller size.

SUMMARY OF THE INVENTION

An object of the present invention is to provide a headphone. The headphone includes a base, an accommodating space, a bracket, a circuit board, a signal cable, a microphone assembly and a sound chamber unit. The base has a sidewall, and an outer wall connected with an outer side of a periphery of the sidewall. The sidewall and the outer wall surround the accommodating space inside the base. An outer side of an upper portion of a junction portion between the sidewall and the outer wall of the base is recessed inward and towards the accommodating space to form a recess. The recess has a blocking wall, a propping wall connected between a lower portion of an outer surface of the blocking wall and an upper portion of an outer wall surface of the outer wall, and two connection walls connected with two opposite ends of the propping wall and two opposite ends of the blocking wall. A bending position is formed between the lower portion of the outer surface of the blocking wall and the upper portion of the outer wall surface of the outer wall, another two bending positions are formed among the two connection walls and the blocking wall, and other two bending positions are formed among the two connection walls and the propping wall. The two opposite ends of the propping wall have two pivoting holes penetrating through the propping wall, and the two pivoting holes are communicated with the accommodating space. At least one connection wall has a through hole penetrating through the at least one connection wall. The through hole is communicated with the accommodating space. The bracket is received in the recess. The bracket includes an outer cover and an inner cover opposite to the outer cover. A cable path is formed between the outer cover and the inner cover. Inner surfaces of two opposite ends of the inner cover protrude towards each other to form two spindles. The two spindles are pivotally inserted into the two pivoting holes. One end of the bracket has a guiding slot formed between the outer cover and the inner cover. The guiding slot is connected to the cable path. The guiding slot is corresponding to the through hole. The circuit board is accommodated in the accommodating space. The circuit board has a soldering portion. The soldering portion is adjacent to the through hole. The signal cable is arranged along the cable path of the bracket, and the signal cable enters the accommodating space of the base through the guiding slot of the bracket and the through hole of the base. The signal cable is connected to the soldering portion of the circuit board. The microphone assembly is accommodated in the accommodating space. The sound chamber unit is accommodated in the accommodating space.

Another object of the present invention is to provide a headphone. The headphone includes a base, a bracket, a circuit board, a signal cable and a sound chamber unit. The base has an accommodating space formed inside the base. An upper portion of an outer periphery of the base is recessed inward and towards the accommodating space to form a recess. The recess has a propping wall and two connection walls. Two opposite ends of the propping wall and the two connection walls form two bending angles at two opposite ends of the recess. The two opposite ends of the propping wall have two pivoting holes penetrating through the propping wall. The two pivoting holes are communicated with the accommodating space. At least one connection wall has a through hole communicated with the accommodating space. The bracket is received in the recess. The bracket includes an outer cover, and an inner cover opposite to the outer cover. A cable path is formed between the outer cover and the inner cover. Inner surfaces of two opposite ends of the inner cover protrude towards each other to form two spindles. The two spindles are pivotally inserted into the two pivoting holes. One end of the bracket has a guiding slot formed between the outer cover and the inner cover. The guiding slot is connected to the cable path. The guiding slot is corresponding to the through hole. The circuit board is accommodated in the accommodating space. The circuit board has a soldering portion. The soldering portion is adjacent to the through hole. The signal cable is arranged along the cable path of the bracket and entering the accommodating space of the base through the guiding slot of the bracket and the through hole of the base. The signal cable is connected to the soldering portion of the circuit board. The sound chamber unit is accommodated in the accommodating space. The base and the bracket, the circuit board and the sound chamber unit are arranged in sequence and arranged from outside to inside.

Another object of the present invention is to provide a headphone. The headphone includes a base, a bracket, a circuit board, a microphone assembly and a sound chamber unit. The base has an accommodating space formed inside the base. An upper portion of an outer periphery of the base is recessed inward and towards the accommodating space to form a recess. The recess is formed in a curved shape. An upper portion of a periphery of the accommodating space has a first convex part opposite to the recess. A lower portion of the bracket is the curved shape. The curve-shaped lower portion of the bracket is received in the curve-shaped recess, and includes a curved part arranged in the curved recess. The circuit board is arc-shaped. The circuit board is located around a lower portion of the periphery of the accommodating space. Two opposite ends of the circuit board are corresponding to two opposite ends of the first convex part. The first convex part and the circuit board cooperate with each other to form a locating space between the first convex part and the circuit board. The microphone assembly is located in the locating space and is mounted in the accommodating space. The sound chamber unit has at least one locating portion located in the locating space and mounted in the accommodating space.

As described above, the signal cable is arranged along the cable path of the bracket to enter the accommodating space of the base through the guiding slot of the bracket and the through hole of the base, after at least one soldering end of the signal cable enters the accommodating space of the base through the through hole of the base, the at least one soldering end of the signal cable is soldered with least one soldering portion of the circuit board by passing through a shorter route, so that an internal space of the base occupied by the signal cable is reduced, and abnormal noises are prevented being caused at the time of the signal cable contacting with the sound chamber unit. The signal cable is soldered to the circuit board for realizing a signal transmission of the headphone. Furthermore, the first convex part and the circuit board surround the periphery of the accommodating space, the microphone assembly and the sound chamber unit are mounted in the accommodating space and are received in the locating space surrounded by the first convex part and the circuit board, a protruding portion of an enclosure is accommodated in an assembly space of a cable reel, and a circle wall of the cable reel is limited in a limiting slot of the enclosure, the headphone reduces a manufacturing cost of the headphone and reduces a volume of the whole headphone by the above-mentioned design of the headphone. In addition, an extending portion is extended downward from a lower portion of the enclosure and increases a chamber volume of an inner space of the enclosure for improving sound quality of the headphone.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
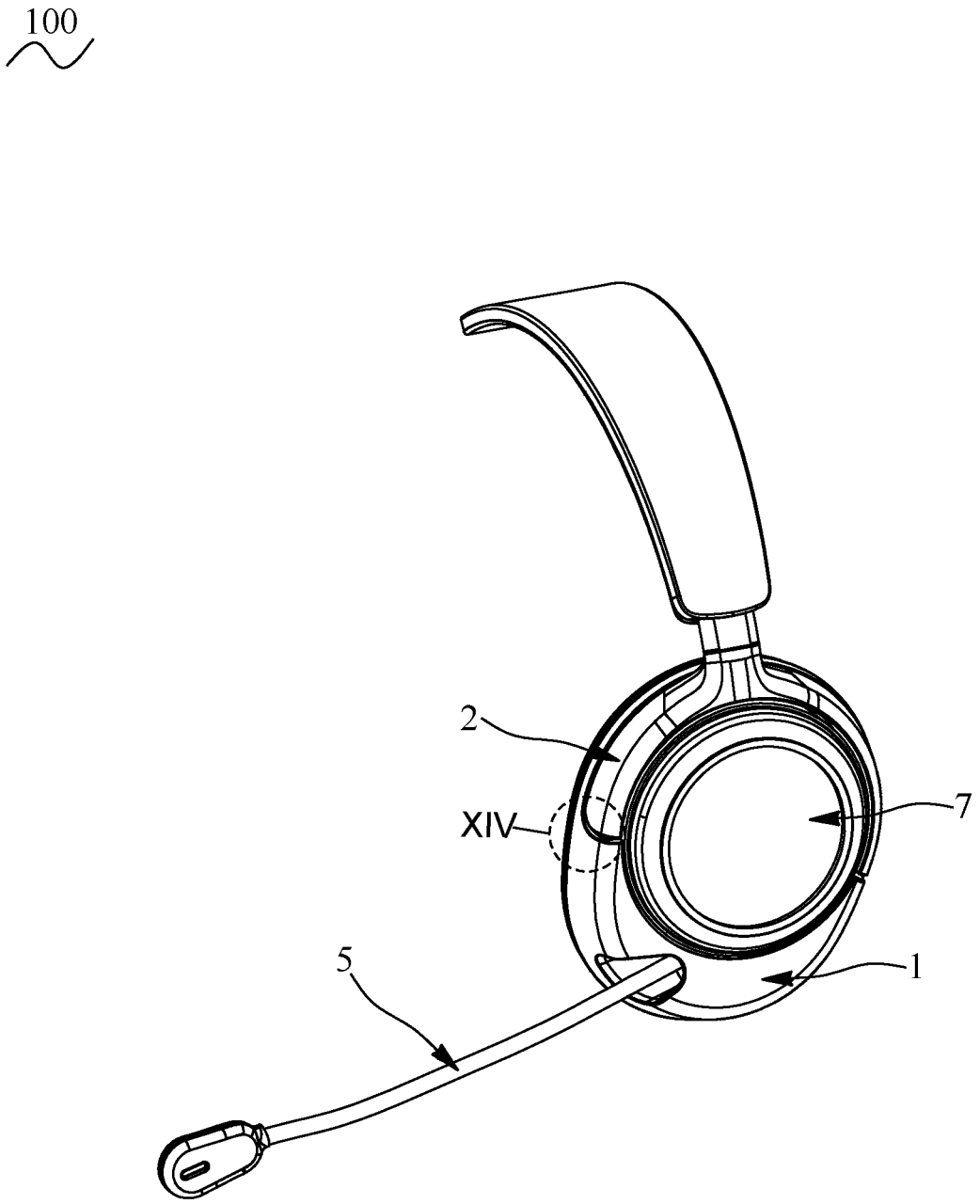
FIG. 1 is a diagrammatic drawing of a headphone in accordance with a preferred embodiment of the present invention, wherein the headphone is in a stretched state.
Figure 2:
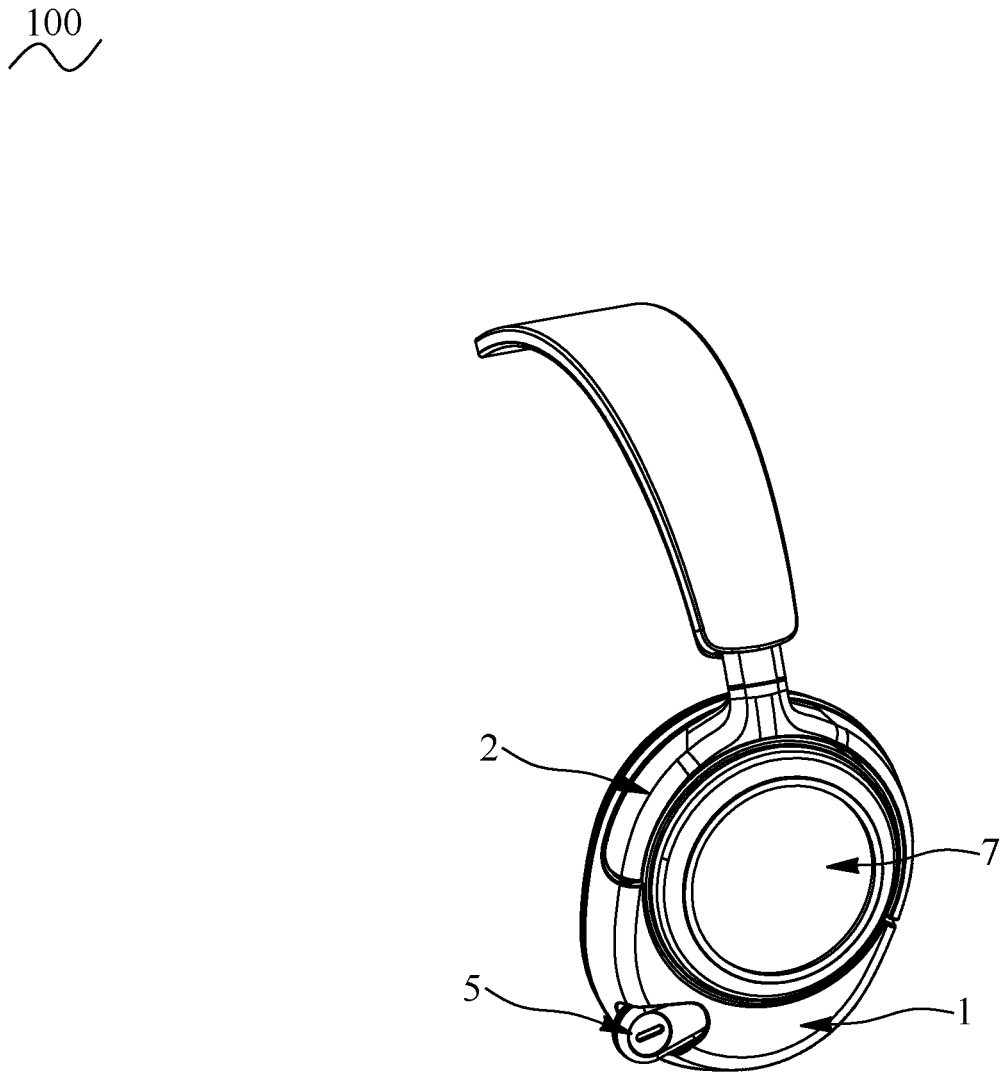
FIG. 2 is a diagrammatic drawing of the headphone in accordance with the preferred embodiment of the present invention, wherein the headphone is in a retracted state.
Figure 3:
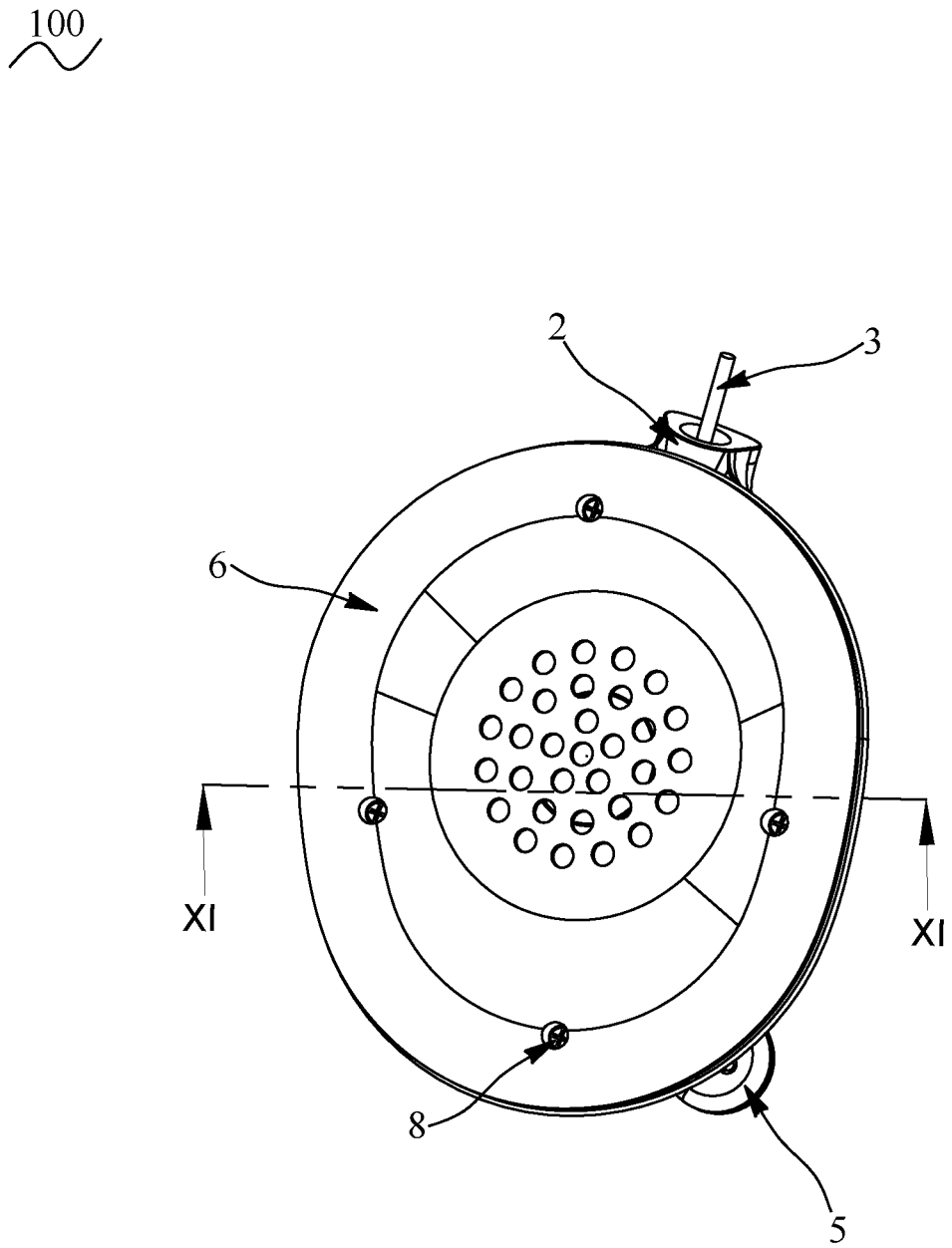
FIG. 3 is a perspective view of the headphone in accordance with the preferred embodiment of the present invention.
Figure 4:
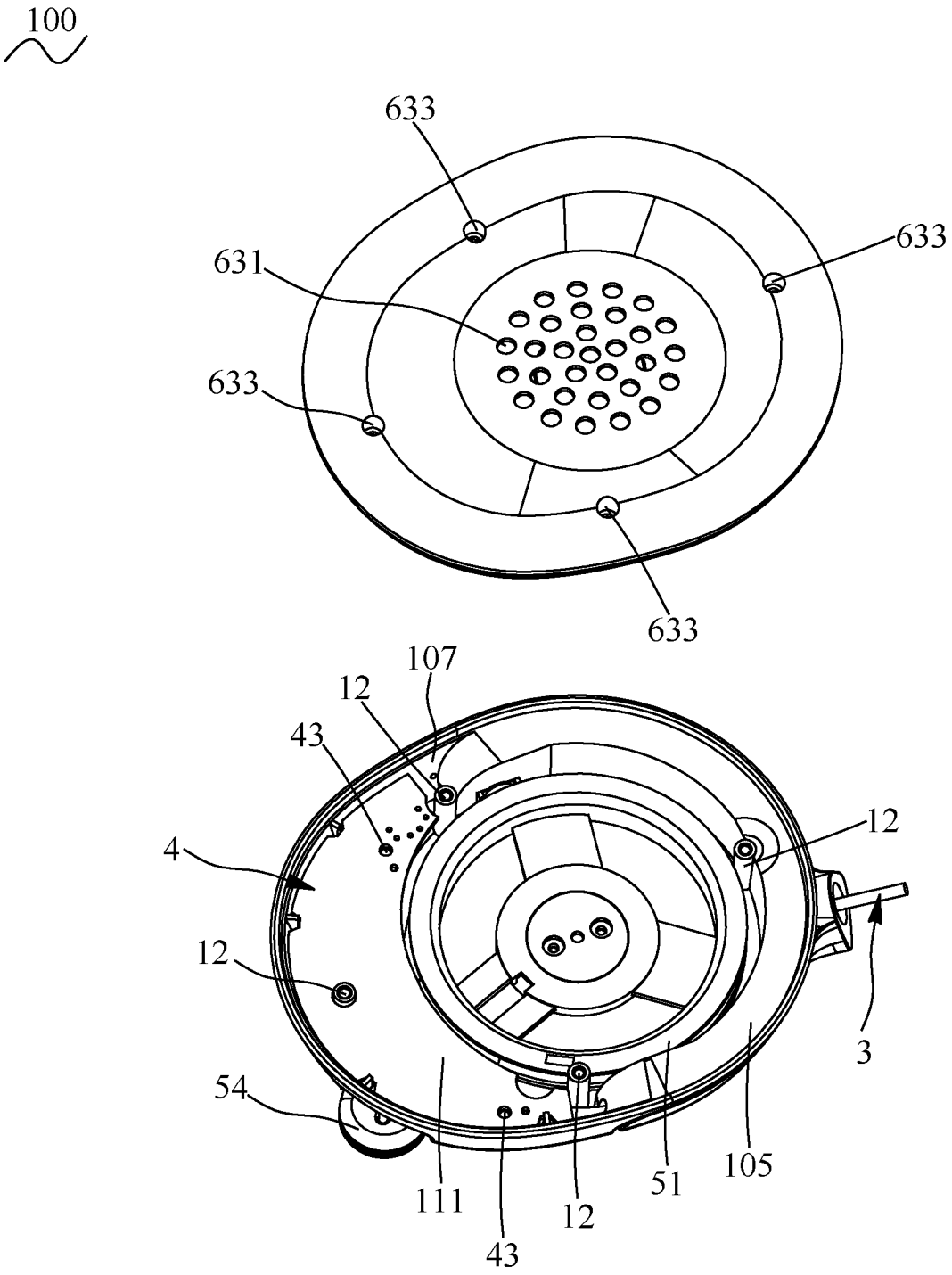
FIG. 4 is a partial exploded view of the headphone in accordance with the preferred embodiment of the present invention.
Figure 5:
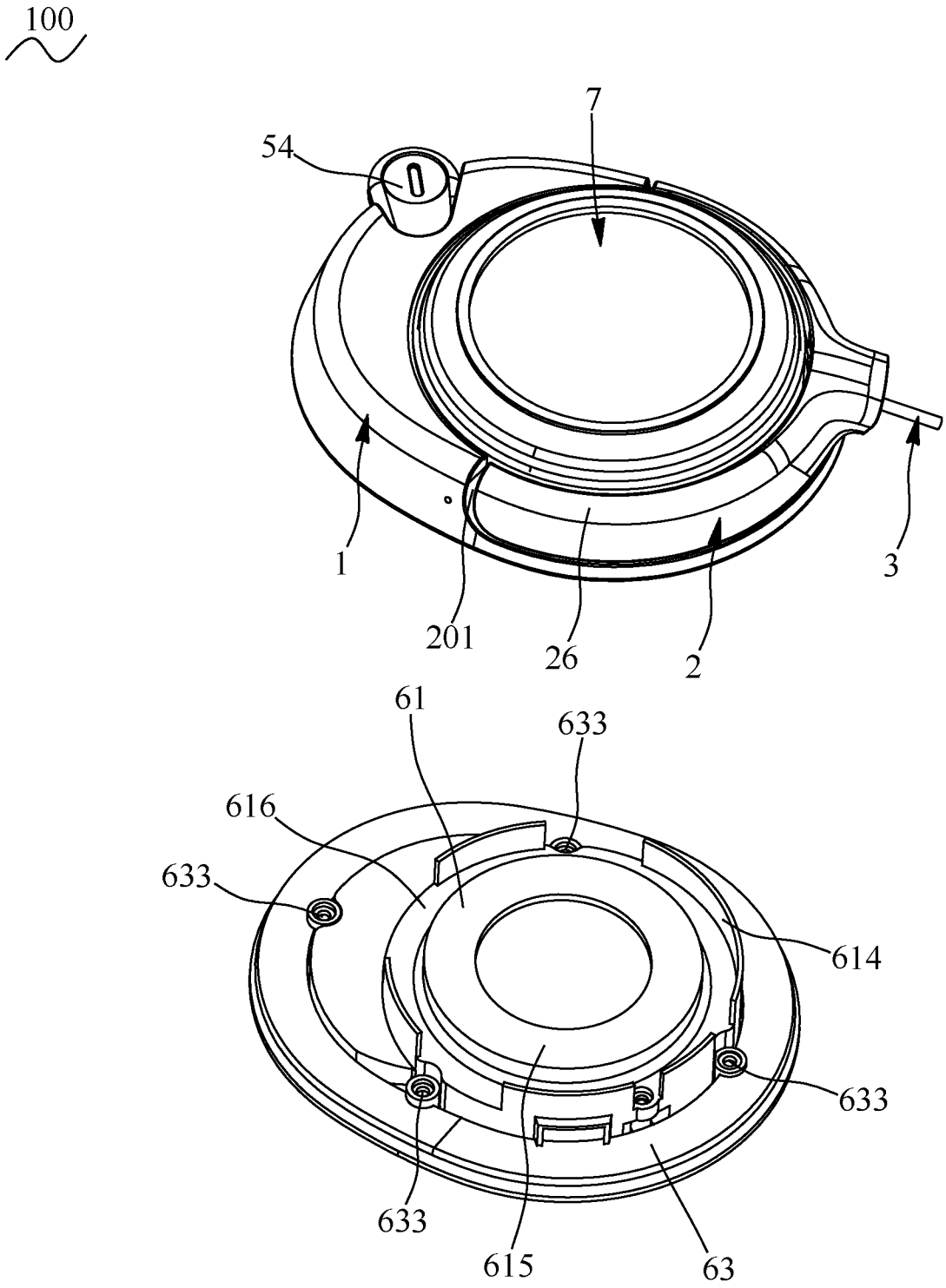
FIG. 5 is another partial exploded view of the headphone in accordance with the preferred embodiment of the present invention.
Figure 6:
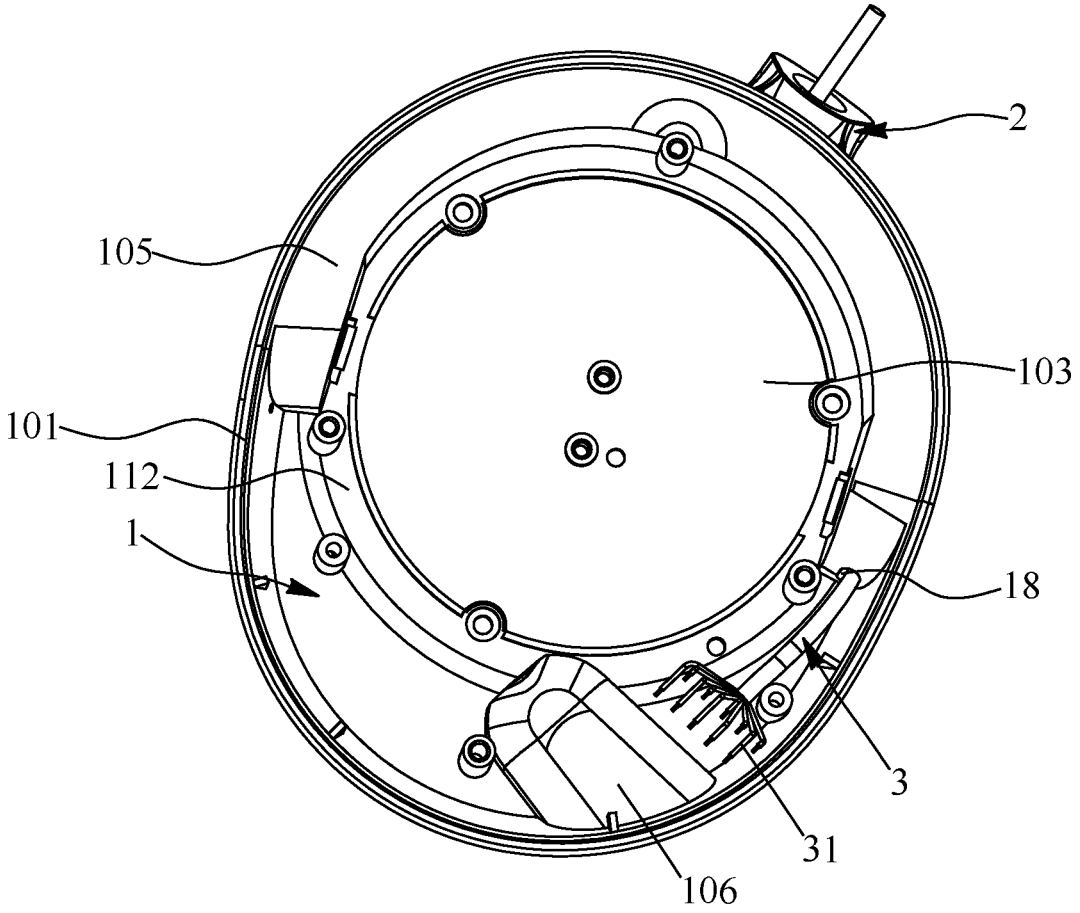
FIG. 6 is another one partial exploded view of the headphone in accordance with the preferred embodiment of the present invention.
Figure 7:
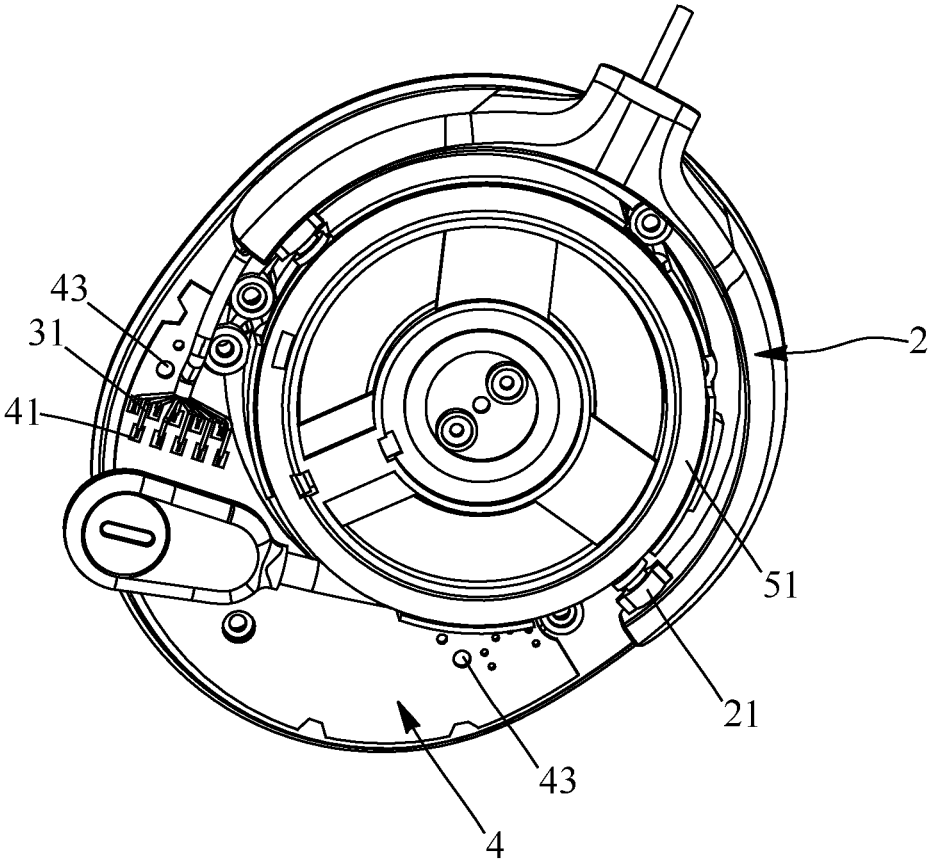
FIG. 7 is one more partial exploded view of the headphone in accordance with the preferred embodiment of the present invention.
Figure 8:
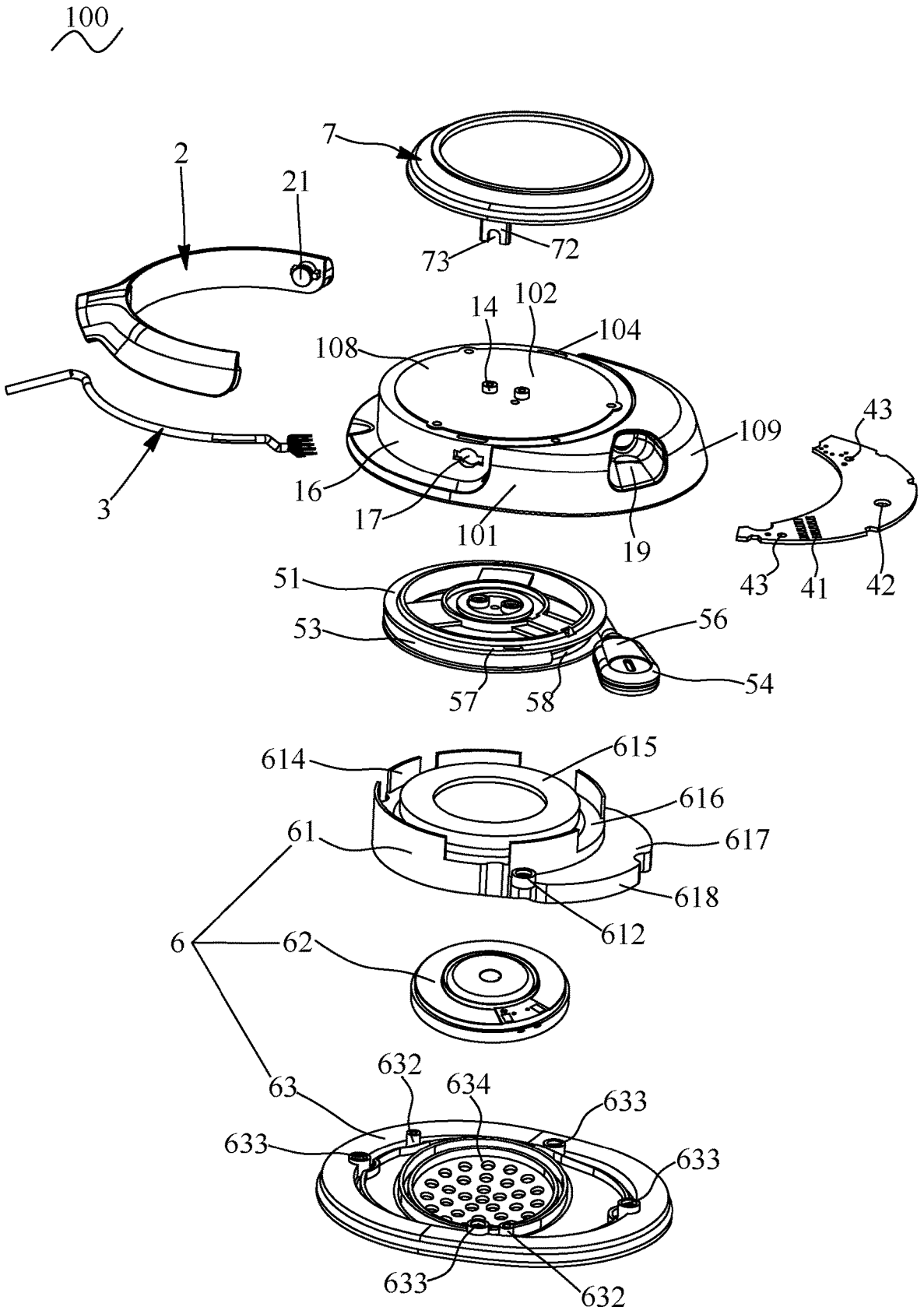
FIG. 8 is an exploded view of the headphone in accordance with the preferred embodiment of the present invention.
Figure 9:
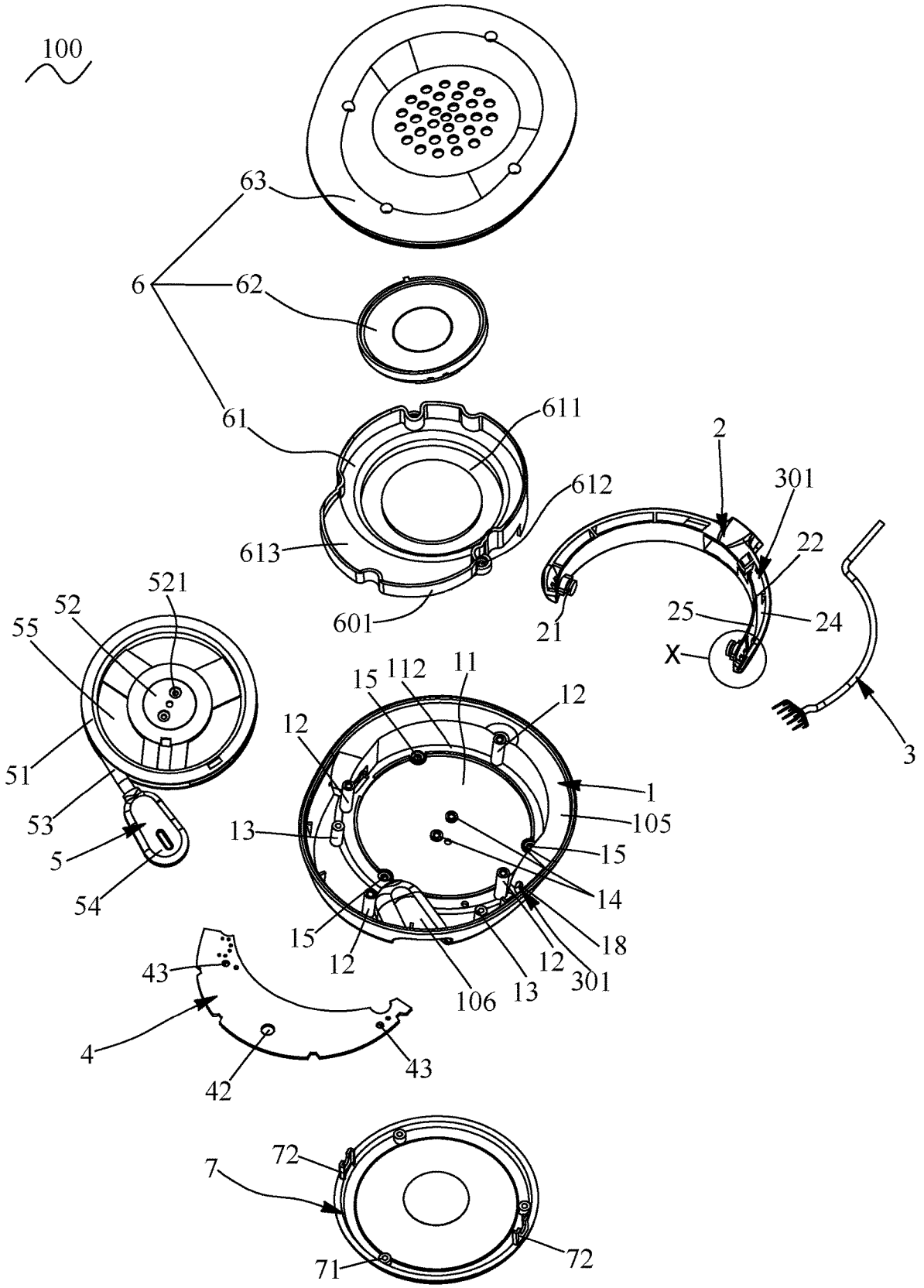
FIG. 9 is another exploded view of the headphone in accordance with the preferred embodiment of the present invention.
Figure 10:
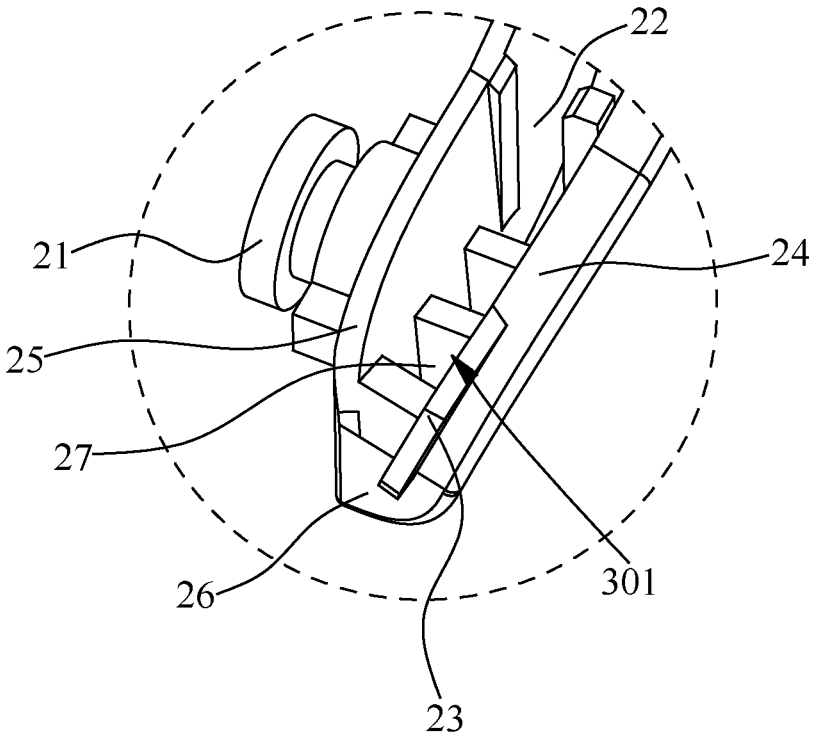
FIG. 10 is an enlarged view of an encircled portion X of the headphone shown in FIG. 9.
Figure 11:
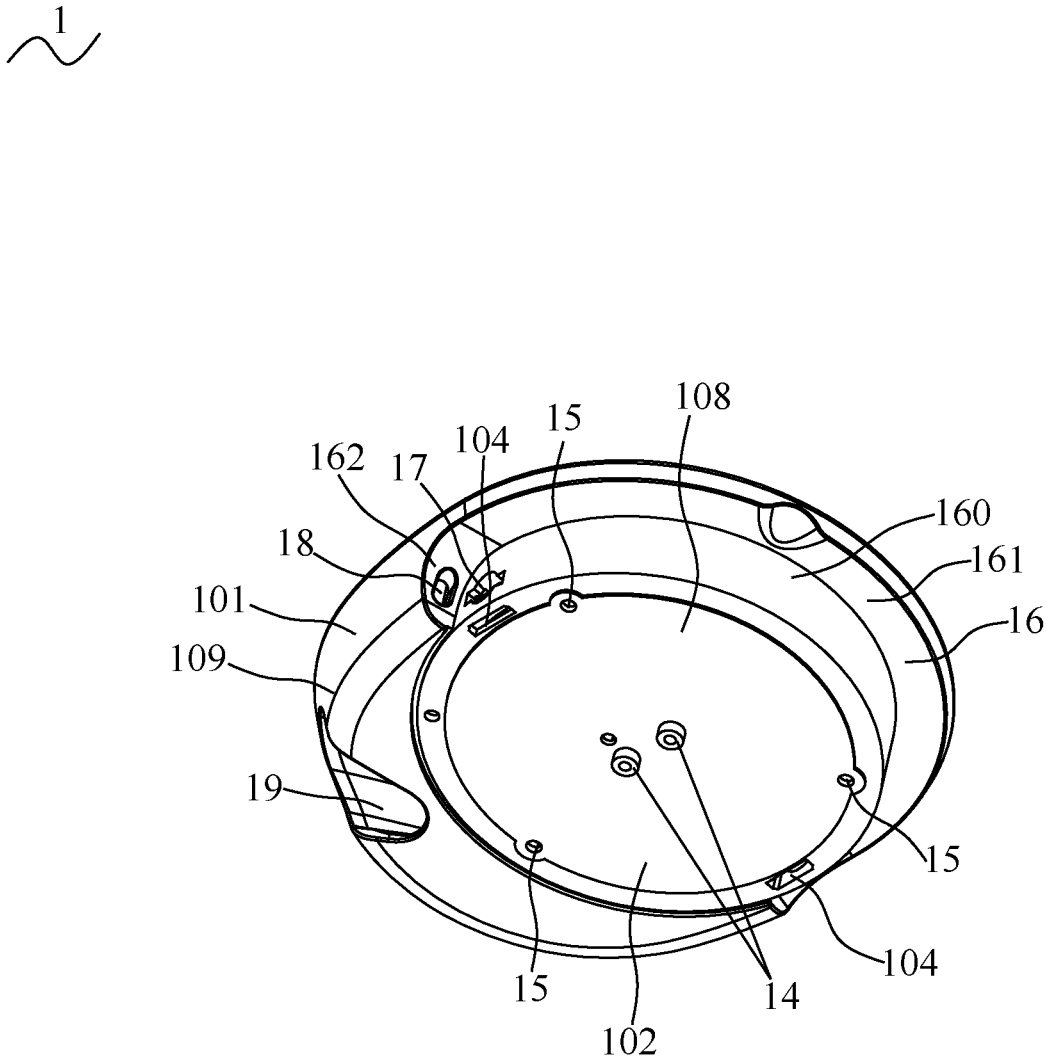
FIG. 11 is a perspective view of a base of the headphone in accordance with the preferred embodiment of the present invention.
Figure 12:
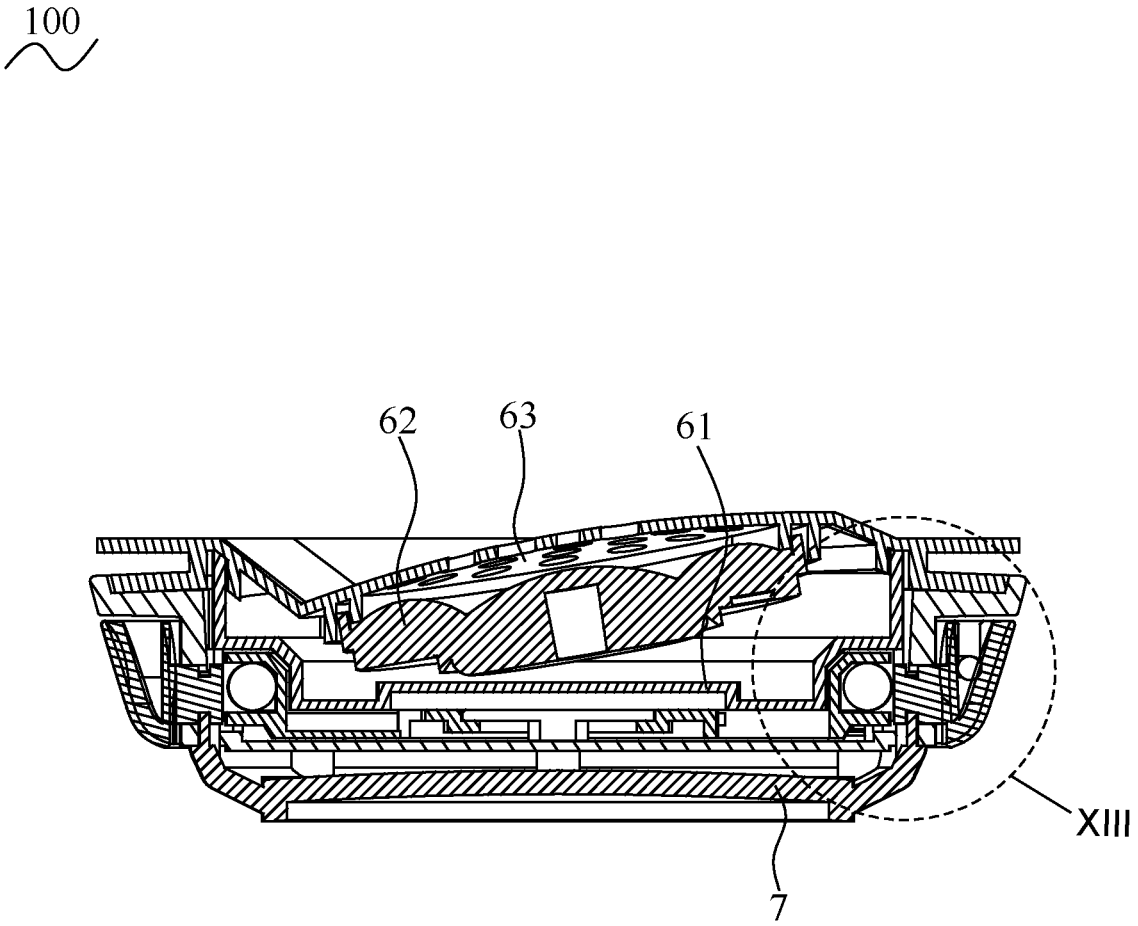
FIG. 12 is a sectional view of the headphone in accordance with the preferred embodiment of the present invention.

Referring to FIG. 1 to FIG. 12, a headphone 100 in accordance with a preferred embodiment of the present invention is shown. The headphone 100 includes a base 1, a bracket 2, a signal cable 3, a circuit board 4, a microphone assembly 5, a sound chamber unit 6 and a decorative cover 7.

The bracket 2 is mounted to a top of the base 1. One end of the signal cable 3 passes through an upper portion of the bracket 2, and the one end of the signal cable 3 further passes through the bracket 2. The signal cable 3 is disposed along an inside of the bracket 2 and the one end of the signal cable 3 passes through a lower end of the bracket 2 and enters the base 1 through the lower end of the bracket 2. The one end of the signal cable 3 is soldered to one end of the circuit board 4. The circuit board 4 is mounted in the base 1. The microphone assembly 5 is mounted in the base 1. The microphone assembly 5 is located at one side of the circuit board 4. The headphone 100 is arranged with the decorative cover 7, the base 1 and the bracket 2, the microphone assembly 5, the circuit board 4 and the sound chamber unit 6. The decorative cover 7, the base 1 and the bracket 2, the microphone assembly 5, the circuit board 4 and the sound chamber unit 6 are arranged in sequence and arranged from outside to inside. The decorative cover 7 is arranged at an outer side of the base 1. In this preferred embodiment, the decorative cover 7 and the bracket 2 are both arranged at the outer side of the base 1. The circuit board 4, the microphone assembly 5 and the sound chamber unit 6 are arranged at an inner side of the base 1.

The base 1 has an accommodating space 11 formed inside the base 1, a plurality of first positioning pillars 12, at least two second positioning pillars 13, at least two third positioning pillars 14, a plurality of first perforations 15, a recess 16, at least two pivoting holes 17, a through hole 18, a receiving hole 19, a sidewall 101, an outer wall 102, an inner wall surface 103, at least two positioning perforations 104, a first convex part 105, a second convex part 106, an inner periphery surface 107, an outer wall surface 108 and an outer periphery surface 109. The sidewall 101 of the base 1 is formed in an annular shape. The outer wall 102 is connected with an outer side of a periphery of the sidewall 101 of the base 1. The sidewall 101 and the outer wall 102 surround the accommodating space 11 inside the base 1. An inside of the sidewall 101 of the base 1 is formed as an opening 111. The outer wall 102 seals up an outer side of the opening 111 to form the accommodating space 11 inside the base 1.

An inner side of the accommodating space 11 is defined as an inner side of the opening 111 located at an inner side of the periphery of the sidewall 101 of the base 1. The circuit board 4, the microphone assembly 5 and the sound chamber unit 6 are accommodated in the accommodating space 11 through the inner side of the opening 111 formed at an inner side of a periphery of the base 1. The outer wall surface 108 is formed at an outer surface of the outer wall 102. The inner wall surface 103 is formed at an inner side of the outer wall 102. The outer periphery surface 109 is formed at an outer surface of the sidewall 101. The inner periphery surface 107 is formed at an inner surface of the sidewall 101.

The plurality of the first positioning pillars 12 are extended towards the sound chamber unit 6 from a periphery of the inner wall surface 103 of the base 1. The at least two second positioning pillars 13 are extended towards the sound chamber unit 6 from the inner wall surface 103 of the base 1. The at least two second positioning pillars 13 are disposed among the plurality of the first positioning pillars 12. The plurality of the first positioning pillars 12 are arranged in the accommodating space 11 for keeping the circuit board 4 and the sound chamber unit 6 in place, and the at least two second positioning pillars 13 are arranged in the accommodating space 11 for keeping the circuit board 4 in place, so that positions of the circuit board 4 and the sound chamber unit 6 are located by the plurality of the first positioning pillars 12 and the at least two second positioning pillars 13.

To be more specific, each first positioning pillar 12 passes through one corresponding structure of the circuit board 4 and the sound chamber unit 6, and two second positioning pillars 13 are corresponding to two corresponding mechanisms of the circuit board 4. The headphone 100 further includes a plurality of screw bolts 8. Then, some of the screw bolts 8 pass through the corresponding structures of the circuit board 4 and the sound chamber unit 6, and the two corresponding mechanisms of the circuit board 4 to be fastened in the plurality of the first positioning pillars 12 and the at least two second positioning pillars 13 for fastening the circuit board 4 and the sound chamber unit 6 in the accommodating space 11 of the base 1. The at least two third positioning pillars 14 are arranged on and penetrate through a middle of the inner wall surface 103 of the base 1. The at least two third positioning pillars 14 are corresponding to corresponding portions of the microphone assembly 5, and some of the screw bolts 8 pass through the corresponding portions of the microphone assembly 5 to be fastened in the at least two third positioning pillars 14 for fastening the microphone assembly 5 in the accommodating space 11 of the base 1.

The outer wall 102 of the base 1 has the plurality of the first perforations 15 penetrating through the inner wall surface 103 and the outer wall surface 108. The plurality of the first perforations 15 are corresponding to corresponding sections of the decorative cover 7. Some of the screw bolts 8 pass through the plurality of the first perforations 15, and then some of the screw bolts 8 are fastened in the corresponding sections of the decorative cover 7 for fastening the decorative cover 7 on the outer wall surface 108 of the outer wall 102 of the base 1. In this preferred embodiment, the decorative cover 7 covers to the outer side of the base 1. The at least two third positioning pillars 14 are surrounded among the plurality of the first perforations 15, and the plurality of the first perforations 15 are arranged among the plurality of the first positioning pillars 12. An upper portion of an outer periphery of the base 1 is recessed inward and towards the accommodating space 11 to form the recess 16. An outer side of an upper portion of a junction portion between the sidewall 101 and the outer wall 102 of the base 1 is recessed inward and towards the accommodating space 11 to form the recess 16 located to an outer side of the accommodating space 11.

When the base 1 is seen from an outside of the base 1, the recess 16 of the base 1 is formed in a curved shape. The bracket 2 is mounted in the recess 16. The recess 16 has a blocking wall 161, a propping wall 160 connected between a lower portion of an outer surface of the blocking wall 161 and an upper portion of the outer wall surface 108 of the outer wall 102, and two connection walls 162 connected with two opposite ends of the propping wall 160 and two opposite ends of the blocking wall 161. The blocking wall 161 is shown as an arc shape, and the propping wall 160 is shown as another arc shape. An upper surface of the propping wall 160 is connected between the lower portion of the outer surface of the blocking wall 161 and the upper portion of the outer wall surface 108 of the outer wall 102, and the propping wall 160 projects beyond the lower portion of the outer surface of the blocking wall 161. An arc-shaped connecting line is formed and connected between the propping wall 160 and the blocking wall 161. The propping wall 160 is bent outward from the lower portion of the outer surface blocking wall 161. A bending position is formed between the lower portion of the outer surface of the blocking wall 161 and the upper portion of the outer wall surface 108 of the outer wall 102.

In this preferred embodiment, upper surfaces of the two connection walls 162 are connected between two opposite ends of the outer surface of the blocking wall 161 and two opposite ends of the upper surface of the propping wall 160, and the two connection walls 162 project beyond the outer surface of the blocking wall 161 and the upper surface of the propping wall 160. The two connection walls 162 are bent between the propping wall 160 and the blocking wall 161. A bending line is formed between and connected between one end of each connection wall 162 and one end of the blocking wall 161, and another bending line of each connection wall 162 is formed between and connected between one side of each connection wall 162 and one end of the propping wall 160. Another two bending positions are formed among the two connection walls 162 and the blocking wall 161, and other two bending positions are formed among the two connection walls 162 and the propping wall 160. The propping wall 160, the blocking wall 161 and the two connection walls 162 cooperate with one another to form the recess 16. The two opposite ends of the propping wall 160 and the two connection walls 162 form two bending angles at two opposite ends of the recess 16. The two opposite ends of the propping wall 160 have the at least two pivoting holes 17 penetrating through the propping wall 160 from the outside to the inside, and the at least two pivoting holes 17 are communicated with the accommodating space 11. Corresponding positions of the bracket 2 are fastened to the at least two pivoting holes 17 to make the bracket 2 buckled outside the base 1. At least one connection wall 162 has the through hole 18 penetrating downward through the at least one connection wall 162. The through hole is communicated with the accommodating space 11. The signal cable 3 passes through the through hole 18 and enters the accommodating space 11 of the base 1. In the preferred embodiment, the two opposite ends of the propping wall 160 have two pivoting holes 17 penetrating through the propping wall 160 from the outside to the inside, and the two pivoting holes 17 are communicated with the accommodating space 11.

A lower portion of the junction portion between the sidewall 101 and the outer wall 102 of the base 1 has the receiving hole 19 penetrating through the junction portion of the sidewall 101 and the outer wall 102. The receiving hole 19 is communicated with the accommodating space 11 of the base 1. The receiving hole 19 accommodates a corresponding location of the microphone assembly 5 to make the microphone assembly 5 extended out of the base 1 from the receiving holes 19. The base 1 has the at least two positioning perforations 104 penetrating through the inner wall surface 103 and the outer wall surface 108 of the outer wall 102, and corresponding segments of the decorative cover 7 are corresponding to and are buckled to the at least two positioning perforations 104 for fastening the decorative cover 7 to the outer wall surface 108 of the outer wall 102 of the base 1.

When the base 1 is seen from an inside of the base 1, the propping wall 160, the blocking wall 161 and the two connection walls 162 of the recess 16 are recessed towards an upper portion of a periphery of the accommodating space 11 to form the first convex part 105. The upper portion of the periphery of the accommodating space 11 has the first convex part 105 opposite to the recess 16. An upper portion of a bending position between the inner wall surface 103 and the inner periphery surface 107 protrudes inward to form the first convex part 105 projecting into the accommodating space 11. The first convex part 105 is designed to be arc-shaped. The microphone assembly 5 is surrounded by the first convex part 105, and the first convex part 105 is formed and surrounded by the propping wall 160, the blocking wall 161 and the two connection walls 162.

A lower portion of the bending position between the inner wall surface 103 and the inner periphery surface 107 of the base 1 protrudes inward to form the second convex part 106 projecting into the accommodating space 11. The receiving hole 19 penetrates through the second convex part 106. The circuit board 4 and the second convex part 106 are both arranged in a lower portion of the periphery of the accommodating space 11. The circuit board 4 is arranged at an inner side of the second convex part 106. The second convex part 106 isolates the microphone assembly 5 from the circuit board 4 to prevent the microphone assembly 5 from contacting with the circuit board 4. The circuit board 4 is covered to the second convex part 106.

In the preferred embodiment, each first positioning pillar 12 and each second positioning pillar 13 are hollow cylinders. A quantity of the plurality of the first positioning pillars 12 is four. A quantity of the second positioning pillars 13 is two and a quantity of the third positioning pillars 14 is two. A quantity of the plurality of the first perforations 15 is three. A quantity of the positioning perforations 104 is two. Each first positioning pillar 12 is longer than each second positioning pillar 13 from the outside to the inside.

A lower portion of the bracket 2 is the curved shape. The bracket 2 is mounted in the recess 16. The upper portion of the bracket 2 projects out of the recess 16. The curve-shaped lower portion of the bracket 2 is matched with and is received in the curve-shaped recess 16. The bracket 2 includes at least two spindles 21, a cable path 22, a shielding plate 23, an outer cover 24, an inner cover 25 opposite to the outer cover 24, and two retaining walls 26 connected between two opposite ends of the outer cover 24 and two opposite ends of the inner cover 25.

Inner surfaces of the two opposite ends of the inner cover 25 of the bracket 2 protrude towards each other to form the at least two spindles 21. In the preferred embodiment, the inner surfaces of the two opposite ends of the inner cover 25 of the bracket 2 protrude towards each other to form two spindles 21. The two spindles 21 are pivotally inserted into the two pivoting holes 17 of the base 1 for fastening the bracket 2 to an upper portion of the base 1. The two spindles 21 acted as a rotating shaft of the bracket 2 are pivoted in the two pivoting holes 17 to make the bracket 2 rotate with respect to the base 1. The cable path 22 is formed between the outer cover 24 and the inner cover 25. Specifically, the cable path 22 is formed among the outer cover 24, the inner cover 25 and the two retaining walls 26 inside the bracket 2.

One end of the bracket 2 has a guiding slot 27. The guiding slot 27 is formed between the outer cover 24 and the inner cover 25. The guiding slot 27 is connected to the cable path 22. When the bracket 2 is assembled to the base 1, the guiding slot 27 is corresponding to the through hole 18 of the base 1. The signal cable 3 is arranged along the cable path 22 of the bracket 2, and the signal cable 3 enters the accommodating space 11 of the base 1 through the guiding slot 27 of the bracket 2 and the through hole 18 of the base 1, so that an internal space of the base 1 occupied by the signal cable 3 is reduced.

Figure 13:
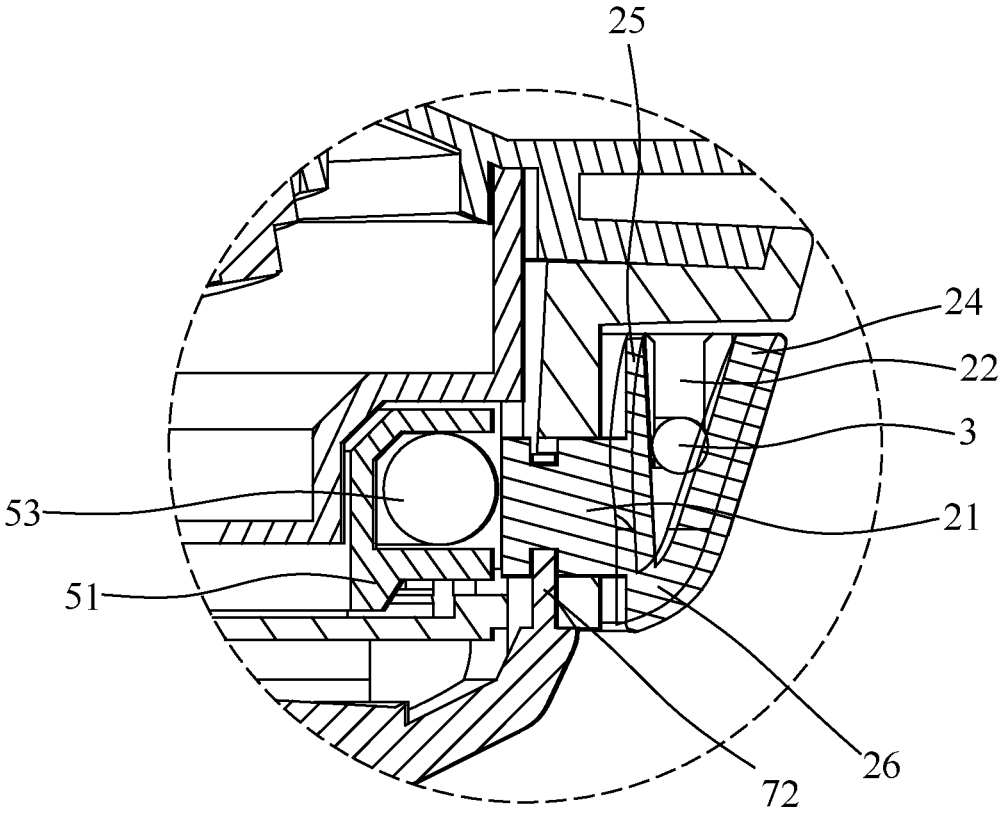
FIG. 13 is a partially enlarged view of an encircled portion XIII of the headphone shown in FIG. 12.
Figure 14:
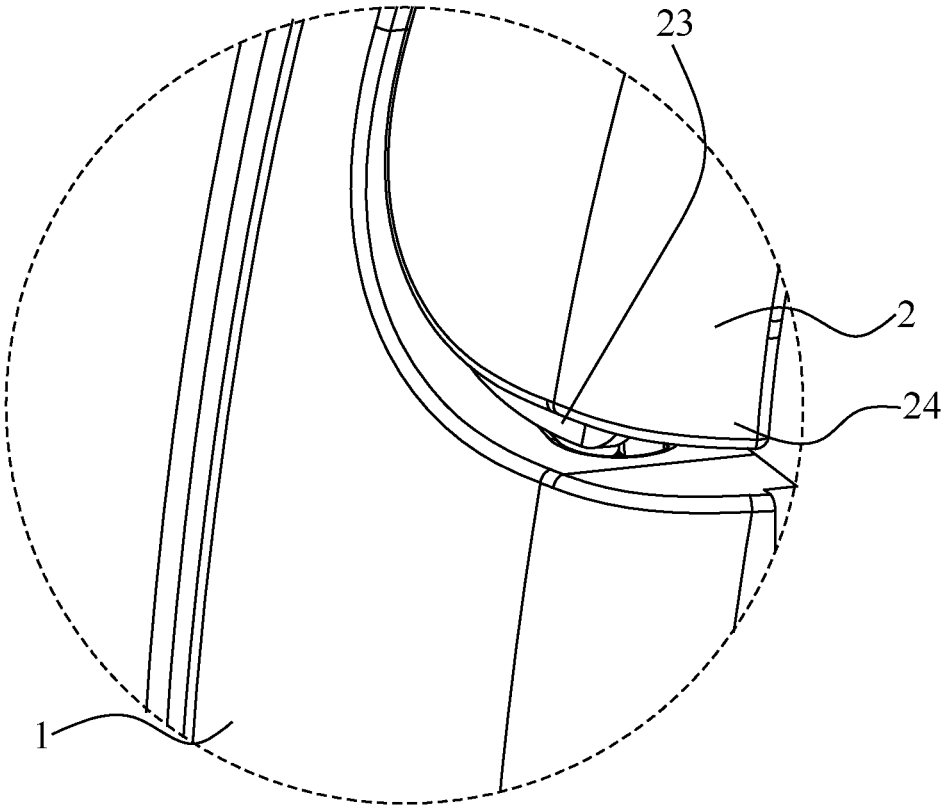
FIG. 14 is a partially enlarged view of an encircled portion XIV of the headphone shown in FIG. 1.

Referring to FIG. 1 to FIG. 14, the signal cable 3 extends in an arc way and in the cable path 22, and the signal cable 3 extends directly out of the bracket 2 from the guiding slot 27. An arrangement way of the signal cable 3 in accordance with the present invention is smoother. Furthermore, after the signal cable 3 enters the accommodating space 11 of the base 1, the signal cable 3 is connected with the one end of the circuit board 4 by passing through a shorter route. The arrangement way of the signal cable 3 prevents the signal cable 3 from contacting with the sound chamber unit 6. Therefore, abnormal noises that are caused at the time of the signal cable 3 contacting with the sound chamber unit 6 are prevented. The shielding plate 23 is extended towards the base 1 from one end of the outer cover 24 of the bracket 2. The shielding plate 23 is positioned at one side of the guiding slot 27 for shielding and protecting the signal cable 3 to prevent the signal cable 3 from being partially exposed in a gap 201 between the base 1 and the bracket 2.

The one end of the signal cable 3 has at least one soldering end 31. The at least one soldering end 31 extends along the cable path 22 of the bracket 2 and enters the accommodating space 11 of the base 1 through the guiding slot 27 of the bracket 2 and the through hole 18 of the base 1. The at least one soldering end 31 of the signal cable 3 is soldered on the corresponding structure of the circuit board 4. The signal cable 3 is prevented being coiled in the base 1 by virtue of the signal cable 3 being disposed in the cable path 22 of the bracket 2, so the internal space of the base 1 occupied by the signal cable 3 is reduced to lower a manufacturing cost of the headphone 100 and reduce a volume of the whole headphone 100, and the abnormal noises produced at the time of the signal cable 3 contacting with the sound chamber unit 6 are prevented from being heard. In the preferred embodiment, the one end of the signal cable 3 has a soldering end 31. The soldering end 31 extends along the cable path 22 of the bracket 2 and enters the accommodating space 11 of the base 1 through the guiding slot 27 of the bracket 2 and the through hole 18 of the base 1. The cable path 22 of the bracket 2, the guiding slot 27 of the bracket 2 and the through hole 18 of the base 1 together define a cable arrangement structure 301.

The circuit board 4 is arc-shaped seen from an inside of the circuit board 4. The circuit board 4 is accommodated in the lower portion of the periphery of the accommodating space 11 of the base 1. The first convex part 105 is located around the upper portion of the periphery of the accommodating space 11, and the circuit board 4 is located around the lower portion of the periphery of the accommodating space 11. Two opposite ends of the circuit board 4 are corresponding to two opposite ends of the first convex part 105, so that the first convex part 105 and the circuit board 4 surround the periphery of the accommodating space 11. The first convex part 105 and the circuit board 4 cooperate with each other to form a locating space 112 between the first convex part 105 and the circuit board 4 for accommodating the microphone assembly 5 and the sound chamber unit 6, and thus the volume of whole headphone 100 in accordance with this present invention is reduced. The microphone assembly 5 is located in the locating space 112 surrounded by the first convex part 105 and the circuit board 4, and mounted in the accommodating space 11. The sound chamber unit 6 has at least one locating portion 601 located in the locating space 112 and is mounted in the accommodating space 11.

The circuit board 4 has at least one soldering portion 41 arranged at an end of a side surface of the circuit board 4, a first positioning hole 42 and at least two second positioning holes 43. After the at least one soldering end 31 of the signal cable 3 enters the accommodating space 11 of the base 1 through the through hole 18 of the base 1, the at least one soldering end 31 of the signal cable 3 is soldered with the at least one soldering portion 41 of the circuit board 4 by passing through the shorter route. The at least one soldering portion 41 is formed at one end of an outer side surface of the circuit board 4, and the at least one soldering end 31 of the signal cable 3 is soldered to the at least one soldering portion 41 for realizing a signal transmission of the headphone 100. In the preferred embodiment, the circuit board 4 has a soldering portion 41. The soldering portion 41 of the circuit board 4 is adjacent to the through hole 18. The signal cable 3 is connected to the soldering portion 41 of the circuit board 4. The soldering end 31 of the signal cable 3 is soldered to the soldering portion 41 of the circuit board 4. The circuit board 4 has the first positioning hole 42. The first positioning hole 42 of the circuit board 4 penetrates through an outer surface and an inner surface of the circuit board 4. The first positioning hole 42 is corresponding to one first positioning pillar 12. The one first positioning pillar 12 penetrates through the first positioning hole 42. Two opposite ends of the circuit board 4 have the at least two second positioning holes 43 penetrating through the inner surface and the outer surface of the circuit board 4. The at least two second positioning holes 43 are corresponding to the at least two second positioning pillars 13. Some of the screw bolts 8 pass through the at least two second positioning holes 43 to be fastened in the at least two second positioning pillars 13 for fastening the circuit board 4 in the base 1. In the preferred embodiment, the headphone 100 includes two second positioning holes 43, and the first positioning hole 42 is located between the two second positioning holes 43.

The microphone assembly 5 includes a cable reel 51 and a microphone 56. The cable reel 51 includes a shaft plate 52, an assembly space 55 and a circle wall 57. The microphone 56 includes a microphone cable 53 and an electroacoustic transducer 54. The cable reel 51 is mounted in the accommodating space 11 of the base 1. The shaft plate 52 is disposed at a middle of the cable reel 51. The circle wall 57 is connected with a periphery of the shaft plate 52. The circle wall 57 and the shaft plate 52 cooperate to form and surround the assembly space 55. A middle of a periphery of the circle wall 57 is recessed inward and towards the assembly space 55 to form a ring groove 58. The microphone cable 53 of the microphone 56 of the microphone assembly 5 is mounted around the circle wall 57 and is received in the ring groove 58 of the cable reel 51. A distal end of the microphone 56 projects out of the ring groove 58.

The microphone 56 is made to be retractable, and the electroacoustic transducer 54 is connected to an end of the microphone cable 53. The electroacoustic transducer 54 is received in the receiving hole 19 to be partially exposed outside from the base 1. The microphone cable 53 is mounted around the cable reel 51 and is received in the ring groove 58 of the cable reel 51. The shaft plate 52 has at least two third positioning holes 521 penetrating through an inner surface and an outer surface of the shaft plate 52. The at least two third positioning holes 521 are arranged to be corresponding to the at least two third positioning pillars 14 of the base 1. Some of the screw bolts 8 penetrate through the at least two third positioning holes 521 to be fastened in the at least two third positioning pillar 14 for fastening the microphone assembly 5 in the accommodating space 11 of the base 1. A corresponding construction of the sound chamber unit 6 is buckled in the assembly space 55 of the microphone assembly 5 for realizing a fixation and a location between the microphone assembly 5 and the sound chamber unit 6.

The sound chamber unit 6 includes an enclosure 61, a loudspeaker 62 and a shell 63. The enclosure 61 has an accommodating chamber 611, at least two fourth positioning holes 612, an extending portion 613, a plurality of stopping walls 614, a protruding portion 615 and a limiting slot 616. The enclosure 61 further has an external wall 617, and a lateral wall 618 connected to an outer periphery of the external wall 617. The external wall 617 and the lateral wall 618 are connected and are cooperated with each other to form and surround the accommodating chamber 611. The loudspeaker 62 is mounted in the accommodating chamber 611. The enclosure 61 has at least two fourth positioning holes 612. The at least two fourth positioning holes 612 penetrate through an inner surface and an outer surface of the enclosure 61. The at least two fourth positioning holes 612 are corresponding to a corresponding composition of the shell 63. Some of the screw bolts 8 pass through the at least two fourth positioning holes 612 to be fastened in the corresponding composition of the shell 63 for fastening the enclosure 61 to the shell 63. A lower portion of the enclosure 61 extends downward to form the extending portion 613 facing towards the circuit board 4 for covering the inner surface of the circuit board 4. The plurality of the stopping walls 614 are extended towards the outer wall 102 of the base 1 from an outer surface of the external wall 617 of the enclosure 61.

In this preferred embodiment, when the enclosure 61 is seen from an outside of the enclosure 61, the plurality of the stopping walls 614 of the enclosure 61 are arranged in a circle array. The protruding portion 615 is extended towards the microphone assembly 5 and the outer wall 102 of the base 1 from the outer surface of the external wall 617 of the enclosure 61. The protruding portion 615 is mounted in a middle of the accommodating space 11 of the base 1. The protruding portion 615 is surrounded among the plurality of stopping walls 614. The limiting slot 616 is formed among the plurality of the stopping walls 614, the external wall 617 and the protruding portion 615. The protruding portion 615 is buckled in the assembly space 55 of the microphone assembly 5. The circle wall 57, the ring groove 58 and the microphone cable 53 of the microphone assembly 5 are limited in the limiting slot 616. The plurality of the stopping walls 614 surround outside the circle wall 57 of the microphone assembly 5. The plurality of the stopping walls 614 block an outside of a periphery of the ring groove 58 partially for fastening the microphone assembly 5 to the enclosure 61. In a concrete implementation, the plurality of the stopping walls 614 are connected with one another to form a continuous wall without an interval.

The shell 63 has a plurality of sound outlet holes 631, at least two fourth positioning pillars 632, a plurality of fifth positioning holes 633 and an assembling part 634. The plurality of the sound outlet holes 631 of the shell 63 penetrate through an inner surface and an outer surface of the shell 63. The at least two fourth positioning pillars 632 are extended towards the base 1 from the shell 63 and are corresponding to the at least two fourth positioning holes 612. Some of the screw bolts 8 penetrate through the at least two fourth positioning holes 612 to be fastened in the at least two fourth positioning pillars 632 for fastening the enclosure 61 to the shell 63. The plurality of the fifth positioning holes 633 of the shell 63 penetrate through the inner surface and the outer surface of the shell 63. The plurality of the fifth positioning holes 633 are corresponding to the plurality of the first positioning pillars 12. Some of the screw bolts 8 penetrate through the plurality of the fifth positioning holes 633 of the sound chamber unit 6 to be fastened in the plurality of the first positioning pillars 12 for fastening the sound chamber unit 6 to the base 1. In this preferred embodiment, the plurality of the sound outlet holes 631 are located among the plurality of the fifth positioning holes 633. The assembling part 634 is recessed inward in a middle of the outer surface of the shell 63, and the loudspeaker 62 is fastened in the assembling part 634 for realizing a location and a fixation between the loudspeaker 62 and the shell 63.

The decorative cover 7 has a plurality of fifth positioning pillars 71 and at least two buckling arms 72. The plurality of the fifth positioning pillars 71 are extended towards the base 1 from an inner surface of the decorative cover 7. The plurality of the fifth positioning pillars 71 are corresponding to the plurality of the first perforations 15 of the base 1. Some of the screw bolts 8 pass through the plurality of the first perforations 15 to be fastened in the plurality of the fifth positioning pillars 71 for fastening the decorative cover 7 on the outer wall 102 of the base 1. The at least two buckling arms 72 are extended towards the base 1 from the inner surface of the decorative cover 7. The at least two buckling arms 72 pass through the at least two positioning perforations 104 of the base 1. The at least two buckling arms 72 extend into the accommodating space 11 and project beyond the inner wall surface 103 of the outer wall 102 of the base 1. An inner surface of a tail end of each buckling arm 72 is recessed towards the inner surface of the decorative cover 7 to form a notch 73. Free ends of the two spindles 21 are buckled in the two notches 73 of the decorative cover 7 to fasten the two buckling arms 72 in the accommodating space 11 of the base 1.

As described above, the headphone 100 has the cable arrangement structure 301, the signal cable 3 is arranged along the cable path 22 of the bracket 2, the signal cable 3 enters the accommodating space 11 of the base 1 through the guiding slot 27 of the bracket 2 and the through hole 18 of the base 1, after the at least one soldering end 31 of the signal cable 3 enters the accommodating space 11 of the base 1 through the through hole 18 of the base 1, the at least one soldering end 31 of the signal cable 3 is soldered with the at least one soldering portion 41 of the circuit board 4 by passing through the shorter route, so that the internal space of the base 1 occupied by the signal cable 3 is reduced. The arrangement way of the signal cable 3 prevents the signal cable 3 from contacting with the sound chamber unit 6. Therefore, the abnormal noises that are caused at the time of the signal cable 3 contacting with the sound chamber unit 6 are prevented. The signal cable 3 is soldered to the circuit board 4 for realizing the signal transmission of the headphone 100. Furthermore, the first convex part 105 and the circuit board 4 surround the periphery of the accommodating space 11, the microphone assembly 5 and the sound chamber unit 6 are mounted in the accommodating space 11 and are received in the locating space 112 surrounded by the first convex part 105 and the circuit board 4, the protruding portion 615 of the enclosure 61 is accommodated in the assembly space 55 of the cable reel 51, and the circle wall 57 of the cable reel 51 is limited in the limiting slot 616 of the enclosure 61, the headphone 100 reduces the manufacturing cost of the headphone 100 and reduces the volume of the headphone 100 by the above-mentioned design of the headphone 100. In addition, the extending portion 613 is extended downward from the lower portion of the enclosure 61 and increases a chamber volume of an inner space of the enclosure 61 for improving sound quality of the headphone 100.

What is claimed is:

1. A headphone, comprising:

a base having a sidewall, and an outer wall connected with an outer side of a periphery of the sidewall;

an accommodating space, the sidewall and the outer wall surrounding the accommodating space inside the base, an outer side of an upper portion of a junction portion between the sidewall and the outer wall of the base being recessed inward and towards the accommodating space to form a recess, the recess having an blocking wall, a propping wall connected between a lower portion of an outer surface of the blocking wall and an upper portion of an outer wall surface of the outer wall, and two connection walls connected with two opposite ends of the propping wall and two opposite ends of the blocking wall, a bending position being formed between the lower portion of the outer surface of the blocking wall and the upper portion of the outer wall surface of the outer wall, another two bending positions being formed among the two connection walls and the blocking wall, and other two bending positions being formed among the two connection walls and the propping wall, the two opposite ends of the propping wall having two pivoting holes penetrating through the propping wall, and the two pivoting holes being communicated with the accommodating space, at least one connection wall having a through hole penetrating through the at least one connection wall, the through hole being communicated with the accommodating space;

a bracket received in the recess, the bracket including an outer cover and an inner cover opposite to the outer cover, a cable path being formed between the outer cover and the inner cover, inner surfaces of two opposite ends of the inner cover protruding towards each other to form two spindles, the two spindles being pivotally inserted into the two pivoting holes, one end of the bracket having a guiding slot formed between the outer cover and the inner cover, the guiding slot being connected to the cable path, the guiding slot being corresponding to the through hole;

a circuit board accommodated in the accommodating space, the circuit board having a soldering portion, the soldering portion being adjacent to the through hole;

a signal cable arranged along the cable path of the bracket, and the signal cable entering the accommodating space of the base through the guiding slot of the bracket and the through hole of the base, the signal cable being connected to the soldering portion of the circuit board;

a microphone assembly accommodated in the accommodating space; and a sound chamber unit accommodated in the accommodating space.

2. The headphone as claimed in claim 1, wherein the bracket includes a shielding plate, the shielding plate is extended towards the base from one end of the outer cover, the shielding plate is positioned at one side of the guiding slot.

3. The headphone as claimed in claim 1, wherein the propping wall, the blocking wall and the two connection walls of the recess are recessed towards an upper portion of a periphery of the accommodating space to form a first convex part, the circuit board is arranged in a lower portion of the periphery of the accommodating space, two opposite ends of the circuit board are corresponding to two opposite ends of the first convex part, one end of the signal cable has a soldering end, the soldering end extends along the cable path of the bracket and enters the accommodating space of the base through the guiding slot of the bracket and the through hole of the base, the soldering end of the signal cable is soldered to the soldering portion of the circuit board.

4. The headphone as claimed in claim 3, wherein the first convex part is designed to be arc-shaped, the circuit board is arc-shaped, the first convex part is located around the upper portion of the periphery of the accommodating space, and the circuit board is located around the lower portion of the periphery of the accommodating space, the first convex part and the circuit board cooperate with each other to form a locating space between the first convex part and the circuit board for accommodating the microphone assembly and the sound chamber unit.

5. The headphone as claimed in claim 3, wherein a lower portion of the junction portion between the sidewall and the outer wall has a receiving hole penetrating through the junction portion of the sidewall and the outer wall, the receiving hole is communicated with the accommodating space of the base, a lower portion of a bending position between an inner wall surface and an inner periphery surface of the base protrudes inward to form a second convex part projecting into the accommodating space, the receiving hole penetrates through the second convex part, the circuit board and the second convex part are both arranged in the lower portion of the accommodating space, the second convex part isolates the microphone assembly from the circuit board.

6. The headphone as claimed in claim 1, wherein the microphone assembly includes a cable reel and a microphone, the cable reel includes a shaft plate, an assembly space and a circle wall, the cable reel is mounted in the accommodating space of the base, the shaft plate is disposed at a middle of the cable reel, the circle wall is connected with a periphery of the shaft plate, the circle wall and the shaft plate cooperate to surround the assembly space, a middle of a periphery of the circle wall is recessed inward and towards the assembly space to form a ring groove, the microphone includes a microphone cable, the microphone cable is mounted around the circle wall and is received in the ring groove, a distal end of the microphone projects out of the ring groove.

7. The headphone as claimed in claim 1, further comprising a decorative cover, the decorative cover having at least two buckling arms, the at least two buckling arms extending towards the base from an inner surface of the decorative cover, the base having at least two positioning perforations penetrating through an inner wall surface and the outer wall surface of the outer wall, the at least two buckling arms passing through the at least two positioning perforations, the at least two buckling arms extending into the accommodating space and projecting beyond the inner wall surface of the outer wall of the base.

8. The headphone as claimed in claim 1, wherein the sound chamber unit includes an enclosure, a loudspeaker and a shell, the enclosure has an accommodating chamber, an extending portion, a plurality of stopping walls, a protruding portion and a limiting slot, the enclosure has an external wall, and a lateral wall connected to an outer periphery of the external wall, the external wall and the lateral wall cooperate with each other to surround the accommodating chamber, the loudspeaker is mounted in the accommodating chamber, a lower portion of the enclosure extending downward to form the extending portion for covering an inner surface of the circuit board, the plurality of the stopping walls are extended towards the outer wall of the base from an outer surface of the external wall of the enclosure, the protruding portion is extended towards the microphone assembly and the outer wall of the base from the outer surface of the external wall of the enclosure, the protruding portion is mounted in the accommodating space, the protruding portion is surrounded among the plurality of the stopping walls, the limiting slot is formed among the plurality of the stopping walls, the external wall and the protruding portion.

9. The headphone as claimed in claim 1, further comprising a decorative cover, the decorative cover, the base and the bracket, the microphone assembly, the circuit board and the sound chamber unit being arranged in sequence and arranged from outside to inside.

10. The headphone as claimed in claim 1, wherein the cable path of the bracket, the guiding slot of the bracket and the through hole of the base together define a cable arrangement structure.

11. A headphone, comprising:

a base having an accommodating space formed inside the base, an upper portion of an outer periphery of the base being recessed inward and towards the accommodating space to form a recess, the recess having a propping wall and two connection walls, two opposite ends of the propping wall and the two connection walls forming two bending angles at two opposite ends of the recess, the two opposite ends of the propping wall having two pivoting holes penetrating through the propping wall, the two pivoting holes being communicated with the accommodating space, at least one connection wall having a through hole communicated with the accommodating space;

a bracket received in the recess, the bracket including an outer cover, and an inner cover opposite to the outer cover, a cable path being formed between the outer cover and the inner cover, inner surfaces of two opposite ends of the inner cover protruding towards each other to form two spindles, the two spindles being pivotally inserted into the two pivoting holes, one end of the bracket having a guiding slot formed between the outer cover and the inner cover, the guiding slot being connected to the cable path, the guiding slot being corresponding to the through hole;

a circuit board accommodated in the accommodating space, the circuit board having a soldering portion, the soldering portion being adjacent to the through hole;

a signal cable arranged along the cable path of the bracket and entering the accommodating space of the base through the guiding slot of the bracket and the through hole of the base, the signal cable being connected to the soldering portion of the circuit board; and a sound chamber unit accommodated in the accommodating space;

wherein the base and the bracket, the circuit board and the sound chamber unit are arranged in sequence and arranged from outside to inside.

12. A headphone, comprising:

a base having an accommodating space formed inside the base, an upper portion of an outer periphery of the base being recessed inward and towards the accommodating space to form a recess, the recess being formed in a curved shape, an upper portion of a periphery of the accommodating space having a first convex part opposite to the recess;

a bracket, a lower portion of the bracket being the curved shape, the curve-shaped lower portion of the bracket being received in the curve-shaped recess, and including a curved part arranged in the curved recess;

a circuit board being arc-shaped, the circuit board being located around a lower portion of the periphery of the accommodating space, two opposite ends of the circuit board being corresponding to two opposite ends of the first convex part, the first convex part and the circuit board cooperating with each other to form a locating space between the first convex part and the circuit board;

a microphone assembly located in the locating space and mounted in the accommodating space; and a sound chamber unit having at least one locating portion located in the locating space and mounted in the accommodating space.

13. The headphone as claimed in claim 12, wherein a lower portion of a junction portion between a sidewall and an outer wall of the base has a receiving hole penetrating through the bending portion of the sidewall and the outer wall and communicated with the accommodating space of the base, a lower portion of a bending position between an inner wall surface and an inner periphery surface of the base protrudes inward to form a second convex part projecting into the accommodating space, the receiving hole penetrates through the second convex part, the circuit board and the second convex part are both arranged in the lower portion of the periphery of the accommodating space, the second convex part isolates the microphone assembly from the circuit board.

* * * * *